United States Patent [19]

Komischke

[11] Patent Number: 4,860,934

[45] Date of Patent: Aug. 29, 1989

[54] CLOSURE FOR RECEPTACLES FOR RECEIVING FREE-FLOWING FILLING MATERIAL

[75] Inventor: Karl-Heinz Komischke, Lehrte, Fed. Rep. of Germany

[73] Assignee: Schmalbach-Lubeca AG, Braunschweig, Fed. Rep. of Germany

[21] Appl. No.: 156,278

[22] Filed: Feb. 16, 1988

[30] Foreign Application Priority Data

Feb. 17, 1987 [DE] Fed. Rep. of Germany ..... 3704977

[51] Int. Cl.[4] ..... B65D 47/06

[52] U.S. Cl. ..... 222/534; 222/536

[58] Field of Search ..... 222/153, 526, 531, 532, 222/534, 533, 536, 537, 538, 540, 498, 556, 559, 560

[56] References Cited

U.S. PATENT DOCUMENTS

| | | | |
|---|---|---|---|
| 2,893,612 | 7/1959 | Akers | 222/536 |
| 2,936,934 | 5/1960 | Kubilivnas | 222/536 X |
| 3,045,880 | 7/1962 | Akers | 222/536 |
| 3,087,657 | 4/1963 | Eckles | 222/531 |
| 3,181,743 | 5/1965 | Libit et al. | 222/538 X |
| 3,718,238 | 2/1973 | Hazard et al. | 222/536 |
| 3,851,805 | 12/1974 | Hazard | 222/534 |
| 3,863,818 | 2/1975 | Hazard | 222/531 |
| 3,874,568 | 4/1975 | La Vange et al. | 222/531 X |
| 4,440,327 | 4/1984 | Dark | 222/534 X |

FOREIGN PATENT DOCUMENTS

| | | | |
|---|---|---|---|
| 0051528 | 5/1982 | European Pat. Off. . | |
| 2357611 | 5/1975 | Fed. Rep. of Germany | 222/534 |
| 3104561 | 8/1982 | Fed. Rep. of Germany . | |
| 2498566 | 7/1982 | France . | |

*Primary Examiner*—Kevin P. Shaver
*Attorney, Agent, or Firm*—Herbert Dubno

[57] ABSTRACT

A closure for receptacles is provided which can be produced in one piece by injection molding or the like from plastic material and has a rigid pouring spout linked to the base of the cap-shaped, substantially rigid closure body which is disposed in swivelling fashion between a locked position folded down in the plane of the base and a position being approximately vertical thereto and is connected to the cap body via a membrane-like flexible wall portion. The pouring spout has at its circumference one or several bar projections, over which a bar projection engages which can be elastically bent outwards in the locked position to secure the pouring spout in this position.

1 Claim, 1 Drawing Sheet

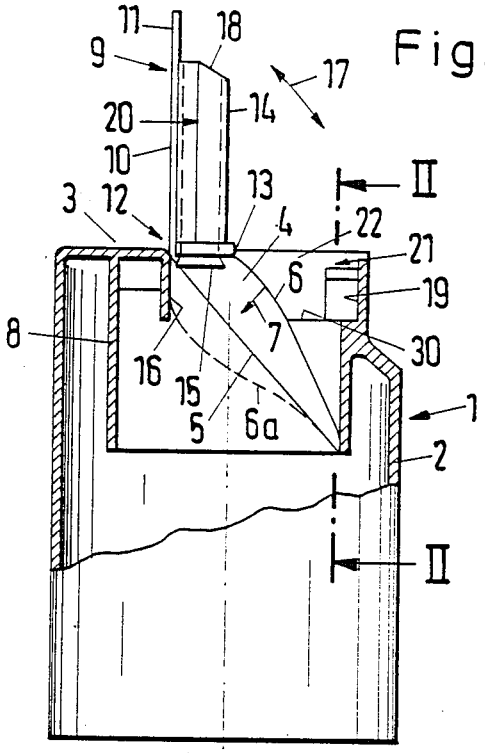
Fig. 1
Fig. 2
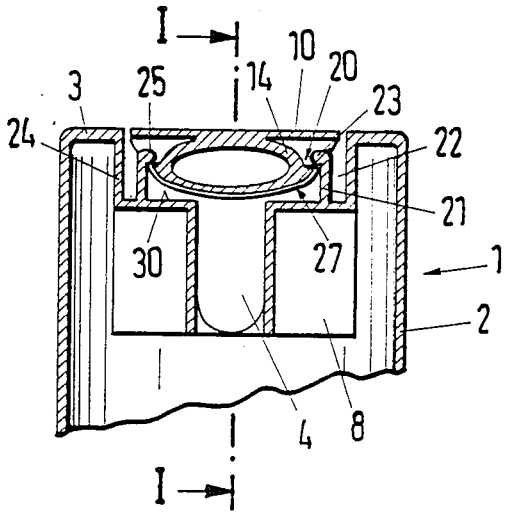

CLOSURE FOR RECEPTACLES FOR RECEIVING FREE-FLOWING FILLING MATERIAL

FIELD OF THE INVENTION

The invention relates to a closure for receptacles for receiving free-flowing filling material.

BACKGROUND OF THE INVENTION

The art has reported many cap-like closures that are fitted with swivelling pouring spouts. Closures have been reported that consist of a substantially rigid closure cap body which can be attached on an end of a receptacle in a firmly sealing fashion. As part of the closure there is a substantially rigid pouring spout which is swivellable on one side via a joint line with the cap base being between a swung-out pouring position and a locked position, the latter being approximately pivoted in the plane of the cap base. Moreover, the spout is connected sealingly to the closure cap body via a membrane-like flexible wall section. At least one end of the pouring spout abuts sealingly against a sealing surface in the interior of the closure cap body in the locked position.

Advantageously the closure is produced in one piece with all its parts,
e.g. by means of injection moulding. The production is effected in the pouring position of the spout, due to which considerable resiliency forces are stored in the locked position of the spout being swivelled with respect to it, which endeavour to move the closure spout again into the open position. However, in order to act reliably as a closure, the pouring spout must be locked sufficiently firmly in the locked position against forces acting against the same in the open position.

SUMMARY OF THE INVENTION

The known closure has herein been improved upon by providing the pouring spout at its circumference with at least one projecting bar section over which a bar projection engages and which can be bent elastically outwards near the cap edge in the locked position.

A closure for a receptacle containing flowable material is provided. The closure comprises:

a substantially rigid closure cap body attached to an end of the receptacle in firmly sealing fashion, the receptacle having a vertical axis that passes through the cap body, and the cap body including:

a cylindrical wall coaxial with the vertical axis, a cap base continuous with but perpendicular to the cylindrical wall, a rigid wall section parallel to the cap base, a pair of webs inward of the cylindrical wall and formed perpendicular to the rigid wall section, the webs having first and second ends, the first end being attached to the rigid wall section, a bar projection facing inwardly and attached to each of the second ends of the webs, a substantially rigid pouring spout including:

a first end connected to the cap base through a joint line whereby the pouring spout is swivellable between a swung-out pouring position and a locked position, the locked position being approximately in a plane defined by the cap base, a second end distant from the first end, a hollow conduit allowing passage of the flowable material, the conduit extending between the first and the second ends, a bar section formed along an outer curved surface of the conduit and projecting outwards elastically engaging the bar projection when the pouring spout is in the locked position, and a membrane-like flexible wall sealingly connecting the cap body with the first end of the spout.

Due to this design the spout can be locked across a considerable portion of its length and on its two longitudinal sides at the same time in snap-like fashion and thus sufficiently firmly to the closure cap body, if the spout is swivelled into the locking position. There is, moreover, the advantage that considerable production tolerances between the parts acting in a snap-like locked fashion can be accepted in the production without endangering the safe locking of the spout in the locking position.

It is especially advantageous if the bar projections disposed on the cap body are disposed on a rigid wall section of the cap body being approximately in parallel to the cap base, but also being disposed in sunken fashion with respect to the same, so that they experience a stable construction and can inwardly project across a sufficient length effective for locking. This wall supporting the bar projections can at the same time be advantageously designed as a connecting wall between the circumferential wall of the cap on the one hand and an inner sleeve being concentrical thereto which extends inwardly from the cap base and at which the edge of the membrane-like flexible wall section can be fixed in one piece. This facilitates on the one hand the production and makes on the other hand a sufficiently large extension of the membrane-like flexible wall section possible to ensure an easy snapping of this wall section upon the swivelling of the pouring spout between its two positions and to avoid at the same time excessive tensions in this wall section or a premature material fatigue.

BRIEF DESCRIPTION OF THE DRAWING

The invention is explained in more detail by means of schematic drawings of an example embodiment wherein.

FIG. 1 shows a section along the sectional line I—I of FIG. 2; and

FIG. 2 shows a section along the sectional line II—II of FIG. 1.

DETAILED DESCRIPTION

According to the example embodiment, the closure 1 has a cylindrical closure cap 2 with plane cap base 3. The wall thickness of the cap body is selected with respect to the type of plastic material employed so that it is relatively rigid. The cap body has an approximately rectangular recess 22 which is closed towards the bottom by a wall 30 being approximately in parallel to the cap base and towards the circumference by a wall 19 extending along a chord of the cap outline. The cap body is recessed at the point of the wall 19 to form a recessed grip to open the closure. A straight wall 16 being in parallel thereto projects downwardly from the cap base 3 at a predetermined distance of the wall 19 disposed along the chord. In the represented example both walls 16 and 19 are at a mutual distance from one another which is equal to or somewhat greater than the radius of the cap body 2. Furthermore, an inner sleeve 8 projecting inwardly from the cap base 3 is provided concentrically to the outer wall 2 of the cap body, which is connected to the circumferential wall 2 of the cap body in the area of the recess 22 via the wall 30.

In the area along which the inner wall 16 is connected to the cap base 3, a cover 10 is linked to the cap base 3 in one piece via a joint line 12. This joint line is formed by a weakening of the material, which is shown in the open position in FIG. 1 and which covers the recess 22 of the cap towards above in the locked position according to FIG. 2. The cover 10 has a free end 11, which projects over the recessed grip at the outer circumference of the cap in the locking position according to FIG. 2 and can thus be easily seized with the fingers.

An oblong pouring spout 14 is shaped in one piece to the circumferential side of the cover 10, whose pouring end 18 cooperated after a swivelling in accordance with the arrow 17 into the locking position with the wall 19. The inner end of the pouring spout has a shaped sealing collar 15 which bears on the wall 16 with bias in the locking position so that both ends of the pouring spout 14 are at least covered in the locked position and the inner end is at the same time sealingly closed.

The pouring spout 14 is connected with the cap base 3 in sealing and articulated fashion via the cover part 10. Moreover, the inner end of the pouring spout 14 is in a sealing, but movable connection with the cap body via a flexible membrane 4 which can be bent outwardly. The same is designed in one piece with the cap parts and is of a small thickness as compared with the other parts. The membrane is firmly connected to the lower end of the pouring spout 14 in the plane of the cap base 3 as this is outlined at 13. Moreover, the flexible wall section 4 is firmly connected to the inner surface of the sleeve 8 along a plane which is outlined at 5. The central area of the flexible wall section 4 is convexly bent to the outside in the open position represented in FIG. 1 as this is outlined by the full line 6. If the pouring spout is moved into the locked position, the wall section 4 snaps and gets into the position 6*a* bent concavely inwardly and represented with a dotted line in FIG. 1. Overloading of the flexible wall section is avoided by its relatively large surface, which is achieved by the fact that the sleeve 8 projects a great distance into the interior of the cap and the flexible wall section 4 extends up to the lower end of the sleeve 8.

To lock the pouring spout 14 which may be of optional cross-section, the spout has oblong bar sections at its side. The same are provided as oblong strips 20, 27 in the preferred represented example embodiment which extend along generatrices of the pouring spout 14 facing each other diametrally. Each web has a locking surface 20 being in the diametreal plane and pointing upwardly in the locked position and a downwardly pointing oblique run-up surface 27.

Upwardly projecting webs 21 or 24 are provided on the partition wall 30 at a distance corresponding to the mutual distance of the surfaces 20. The same project from the wall 30 upwardly in the direction towards the cap base 3. At their upper free edges they have bendings or beads 23, 25 projecting inwardly in the direction towards the pouring spout 14, which are disposed in such fashion that they engage behind the surfaces 20 in the locked position. Due to this, a locking of the pouring spout in the locked position is achieved which ensures a maintaining of this locked position also with respect to considerable elastic resetting forces or against mechanical actions on the grip section 11 of the cover. The locking engagement extends across a considerable length of the closure sleeve 14 which promotes the safe support.

I claim:

1. A one-piece closure for a receptacle containing flowable material, said closure comprising:

a substantially rigid closure cap body attached to an end of said receptacle in firmly sealing fashion, said receptacle having a vertical axis that passes through said cap body, and said cap body including:

a cylindrical wall coaxial with said vertical axis, a cap base continuous with but perpendicular to said cylindrical wall, a rigid wall section parallel to said cap base and defining a bottom of a generally rectangular recess formed in said base, a sleeve coaxial with said cylindrical wall and extending from said rigid wall section away from said cap base;

a pair of webs inward of said cylindrical wall and formed perpendicular to said rigid wall section and on said rigid wall section, said webs having first and second ends, said first ends being formed on said rigid wall section, a respective bar projection facing inwardly and formed on each of said second ends of said webs; and a substantially rigid pouring spour including:

a plate having a first end connected to said cap base through a joint line whereby said pouring spout is swivellable between a swung-out pouring position and a locked position, said plate in said locked position being approximately in a plane defined by said cap base and covering said recess, said plate having a second end distant from said first end of said plate, a hollow conduit formed on said plate allowing passage of said flowable material, said conduit extending between said first and second ends of said plate in said recess in said locked position of said spout, respective bar sections formed along opposite sides of an outer curved surface of said conduit and projecting outwardly and elastically engageable by the respective bar projections when said pouring spout is in the locked position, and a membrane-like flexible wall sealingly connecting said sleeve with a first end of said spout.

* * * * *